US010160250B2

(12) United States Patent
Peleman

(10) Patent No.: US 10,160,250 B2
(45) Date of Patent: Dec. 25, 2018

(54) LAMINATING DEVICE AND USE OF THIS LAMINATING DEVICE

(71) Applicant: UNIBIND LIMITED, Nicosia (CY)

(72) Inventor: Guido Peleman, Antwerp (BE)

(73) Assignee: UNIBIND LIMITED, Nicosia (CY)

( * ) Notice: Subject to any disclaimer, the term of this patent is extended or adjusted under 35 U.S.C. 154(b) by 0 days.

(21) Appl. No.: 14/787,026

(22) PCT Filed: May 2, 2014

(86) PCT No.: PCT/IB2014/000648

§ 371 (c)(1),
(2) Date: Oct. 26, 2015

(87) PCT Pub. No.: WO2014/191800

PCT Pub. Date: Dec. 4, 2014

(65) Prior Publication Data

US 2016/0107470 A1 Apr. 21, 2016

(30) Foreign Application Priority Data

May 28, 2013 (BE) ..... 2013/0371
Sep. 30, 2013 (BE) ..... 2013/0650

(51) Int. Cl.
*B42F 9/00* (2006.01)
*B42D 3/00* (2006.01)

(52) U.S. Cl.
CPC ..... *B42D 3/002* (2013.01); *B42F 9/00* (2013.01); *B42F 9/008* (2013.01)

(58) Field of Classification Search
CPC ..... B42F 9/00; B42F 9/008
USPC ..... 281/27.3
See application file for complete search history.

(56) References Cited

U.S. PATENT DOCUMENTS 3,222,085 A 12/1965 Young
4,928,995 A * 5/1990 Pickering ..... B42D 3/002 281/29
5,066,182 A * 11/1991 Stonebraker ..... B42F 9/008 281/36
6,746,050 B2 * 6/2004 Peleman ..... B42D 3/06 281/21.1
2005/0104361 A1 5/2005 Peleman
2006/0051085 A1 3/2006 Okumura
(Continued)

FOREIGN PATENT DOCUMENTS

AU 2002 100 656 A4 11/2002
AU 2002100656 A4 * 11/2002
CN 2265292 Y 10/1997
(Continued)

OTHER PUBLICATIONS

International Search Report for PCT/IB2014/000648 dated Jul. 4, 2014 [PCT/ISA/210].
(Continued)

*Primary Examiner* — Kyle R Grabowski
(74) *Attorney, Agent, or Firm* — Sughrue Mion, PLLC

(57) ABSTRACT

Binding element (1) for a bundle of leaves (9), whereby the binding element (1) comprises a spine (2) for enclosing an edge of the bundle (9) and two plastic cover sheets (3,4) fastened to the spine (2), characterized in that a first of the cover sheets (3) is transparent and the second of the cover sheets (4) is translucent but not transparent.

9 Claims, 2 Drawing Sheets

(56) References Cited

U.S. PATENT DOCUMENTS

Figure 1:
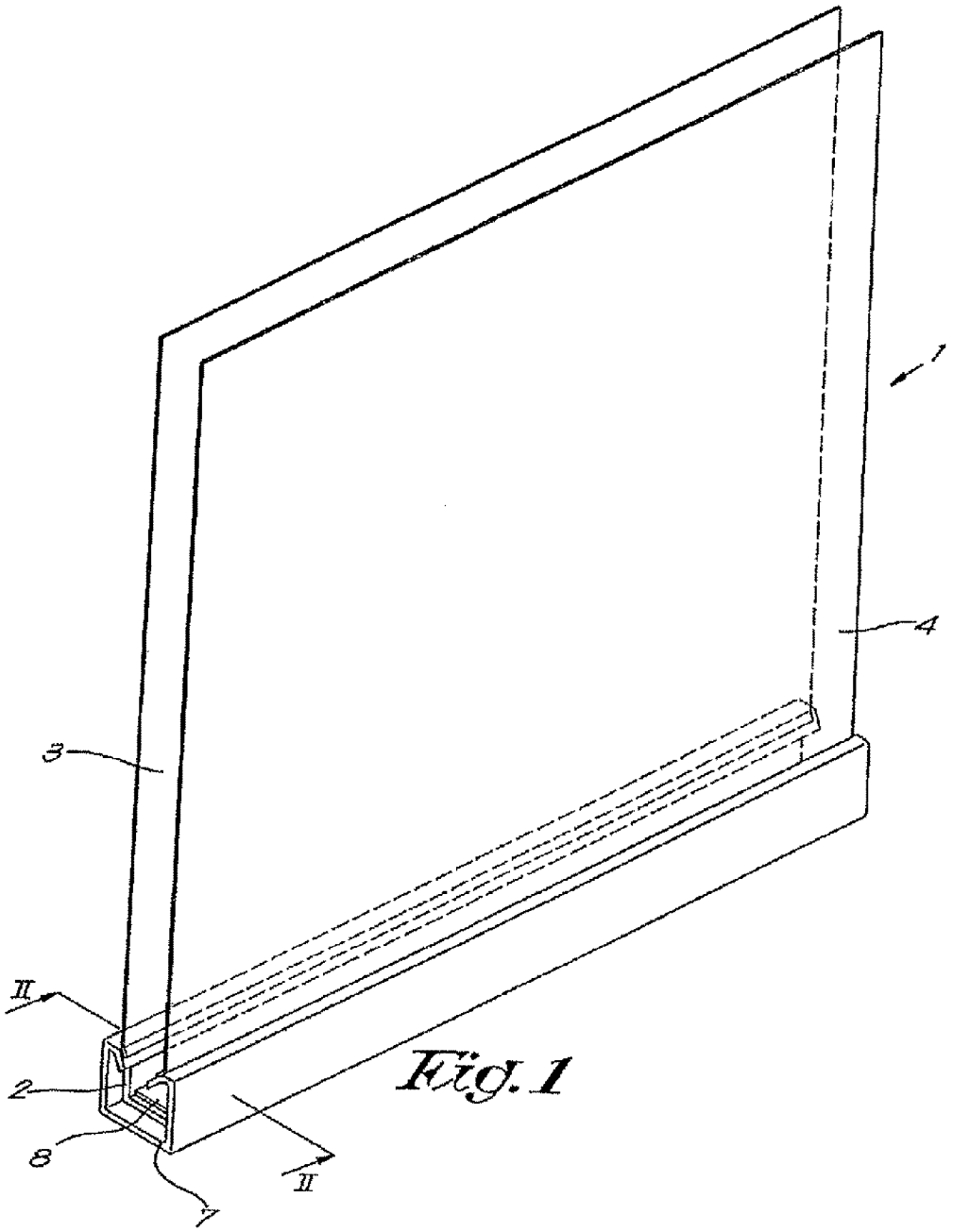

2013/0189055 A1* 7/2013 Bloomberg ..... B42B 5/06
281/21.1

FOREIGN PATENT DOCUMENTS

| | | | | |
|---|---|---|---|---|
| CN | 2495471 | Y | 6/2002 | |
| CN | 1751893 | A | 3/2006 | |
| CN | 2797052 | Y | 7/2006 | |
| CN | 101161465 | A | 4/2008 | |
| GB | 2 197 256 | A | 5/1988 | |
| WO | WO 2013050843 | A1 * | 4/2013 | ..... B42C 9/0056 |

OTHER PUBLICATIONS

International Preliminary Report on Patentability dated Jul. 4, 2014 [PCT/IPEA/409].
Communication dated Dec. 14, 2017 from the State Intellectual Property Office of the P.R.C. in counterpart application No. 201480030087.5.

* cited by examiner

LAMINATING DEVICE AND USE OF THIS LAMINATING DEVICE

CROSS REFERENCE TO RELATED APPLICATIONS

This application is a National Stage of International Application No. PCT/IB2014/000648 filed May 2, 2014, claiming priority based on Belgium Patent Application Nos. 2013/0371 filed May 28, 2013 and 2013/0650 filed Sep. 30, 2013, the contents of all of which are incorporated herein by reference in their entirety.

The present invention relates to a binding element.

More specifically, the invention relates to a binding element that is provided with a spine, intended for the insertion of an edge of a bundle of leaves, with cover sheets on the spine to protect the bundle of documents.

Such a binding element enables an attractive bound bundle of leaves, in other words a booklet, to be made easily and flexibly.

Such binding elements are known. They generally essentially consist of a metal U-shaped spine provided with hotmelt adhesive, whose arms are 7-8 mm long and to which two cover sheets are attached, one cover sheet for the front of the bundle and one cover sheet for the back of the bundle.

The arms can be tapered towards one another to fit the bundle relatively accurately or even to clamp in the bundle. This can also help to bring the leaves of the bundle, and especially the outermost leaves, into good contact with the hotmelt adhesive in the spine.

However, the known binding elements have the disadvantage that the cover sheets are either translucent with a matt surface, or transparent with a gloss surface. A transparent gloss cover sheet is generally visually more attractive, while a translucent matt cover sheet has better scratch resistance. The preference of the user also plays a role in this choice.

This means that a double stock must be kept, which of course entails costs.

A further disadvantage is that a stock of a relatively large number of widths has to be kept to be able to bind different bundle thicknesses.

A machine is also needed to adjust the distance between the arms, which is of course not available to everyone and which carries a certain cost.

A further problem is posed when heating the spine, which is necessary to melt the hotmelt adhesive and thereby to secure the bundle in the binding element, thermal damage, especially deformation, can occur on the cover sheets at the place where they are secured to the spine.

The purpose of the present invention is to provide a solution to the aforementioned and other disadvantages, by providing a binding element for a bundle of leaves, whereby the binding element comprises a spine for enclosing an edge of the bundle and two plastic cover sheets fastened to the spine, whereby a first of the cover sheets is transparent and the second of the cover sheets is translucent but not transparent.

Transparent here means that the cover sheet is completely see-through so that a clear, non-diffuse image can be observed through the cover sheet, while translucent means that the cover sheet has a diffusing effect on an image observed through the cover sheet, so that this image is hazy to an extent that depends on the distance from the cover sheet to the observed object.

This enables bound bundles of leaves to be formed with a front that is transparent or with a front that is translucent, according to choice, with only one stock of binding elements by simply using the binding element in the desired orientation with respect to the bundle.

In preferred embodiments the first cover sheet has a gloss surface and/or the second cover sheet has a matt surface.

In another preferred embodiment the spine is provided with a layer of hotmelt adhesive on its inside.

In a further preferred embodiment the spine is a U-shaped spine with a base and two arms, whereby the spine is symmetrical with respect to the plane that extends in the centre between the two arms and is perpendicular to the base.

This has the advantage that, depending on the orientation of the binding element with respect to the bundle, the same visual result is always obtained, except of course for the type of cover sheet.

In another preferred embodiment at least one of the cover sheets is heat sensitive and the arms have a length of at least 9 mm, and preferably 9.5 to 11.5 mm. It is not excluded that the arms have a longer length. As a result fewer widths can suffice, because the bundle thicknesses for which a certain binding element can be used can be adjusted over a larger distance by bending the arms thanks to conventional binding elements.

By heat sensitive is meant that changes in the material of the cover sheets occur under the influence of heat which have negative consequences during binding or require additional measures and/or which are irreversible and thereby influence influence the properties of the cover sheets.

In a preferred embodiment the spine is provided with a coating, where a heat sensitive cover sheet of both heat sensitive cover sheets is or are attached to the arms via the coating.

The coating causes a reduced heat transfer from the spine to the cover sheets compared to a spine without coating, thereby further reducing the temperature to which to cover sheets are exposed.

The coating preferably has a low heat conductivity, and is not heat sensitive at a temperature lower than or equal to the melting temperature of the hotmelt adhesive.

The coating is preferably made from paper, textile or plastic.

The cover sheets are also less affected by the heat during the melting of the adhesive, because they are further from the base, and are thus at a distance from the heating element used to melt the adhesive. A longer arm also gives off more heat to the environment, so that the cover sheets are exposed to a lower temperature.

The advantages as a consequences of the abovementioned length of the arms and the coating can be obtained independently of the nature of the cover sheets, for which reason the invention alternatively concerns: a binding element for a bundle of leaves, whereby the binding element comprises a U-shaped spine with a base and two arms for enclosing an edge of the bundle and two cover sheets, each secured to a different arm, whereby at least one of the cover sheets is heat sensitive and the arms have a length of 9 mm or more and preferably of 9.5 to 11.5 mm.

In a further preferred embodiment the spine is primarily made of metal, whereby the spine is plastically deformable by manually pushing the arms together without tools in order to be able to adjust the distance between the ends of the arms turned away from the base.

This has the advantage that the distance of the arms can be manually adjusted without potentially expensive machinery. This can be partially or entirely achieved by the longer arms, compared to the known binding elements, such that a longer lever occurs, but the nature and thickness of the spine can also play a role here.

This advantage can be obtained independently of the nature of the cover sheets, for which reason the invention alternatively concerns: a binding element for a bundle of leaves, whereby the binding element comprises a U-shaped spine with a base and two arms for enclosing an edge of the bundle and two plastic cover sheets secured to the spine, whereby the spine is primarily made of metal, whereby the spine is plastically deformable by pushing the arms together manually without tools to be able to adjust the distance between the ends of the arms turned away from the base.

Hereby the arms preferably also have the aforementioned preferred lengths and the spine can also be provided with a layer of hotmelt adhesive.

Figure 2:
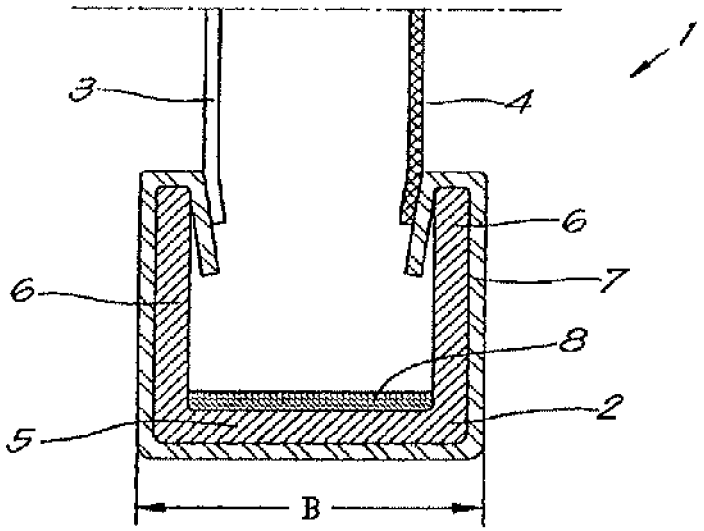
Figure 3:
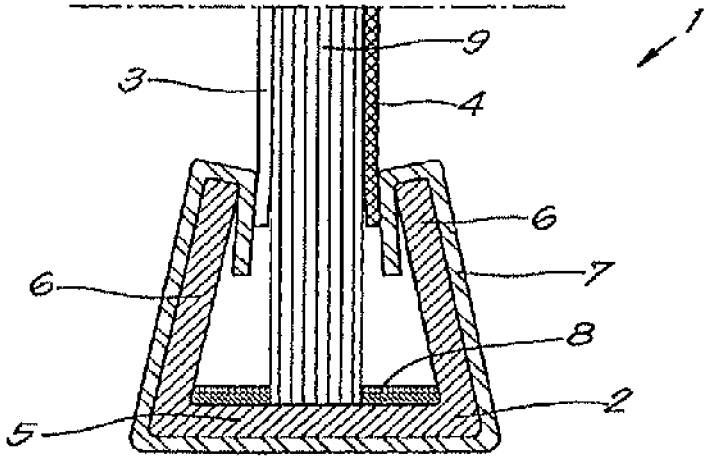

With the intention of better showing the characteristics of the invention, a preferred embodiment of a binding element according to the invention is described hereinafter by way of an example, without any limiting nature, with reference to the accompanying drawings, wherein:

FIG. 1 schematically shows a perspective view of binding element according to the invention;

FIG. 2 shows a side view of a cross-section of the binding element of figure according to II-II; and FIG. 3 shows the use of the binding element in the view as in FIG. 2.

The binding element 1 shown in the drawings essentially consists of a U-shaped spine 2 of deformable steel and two plastic cover sheets 3,4.

The first cover sheet 3 is made of colourless plastic, and is completely transparent and has a gloss surface. The second cover sheet 4 is also made of colourless plastic, whereby the surface is matt, so that this second cover sheet is translucent but not transparent.

The U-shaped spine 2 has a base 5 and two arms 6, and is enclosed by a decorative layer 7. The arms 6 have a length L of 11 mm. The width B of the base 5 is also 11 mm. A layer of hotmelt adhesive 8 is affixed on the inside of the base 5.

The cover sheets 3,4 are each fastened to an arm 6, more specifically to the inside of the arms 6, close to the end of the arms 6 turned away from the base 5.

The use of the binding element is simple and as follows, as illustrated in FIG. 3.

A bundle 9 of leaves is brought between the arms 6. Then the arms 6 are bent towards one another. Thanks to the relatively long arms 6 and the nature of the steel from which the spine 2 is made, this can be done by hand by taking the arms 6 between the thumb and forefinger at a few places spread over the length of the binding element 1 and firmly pushing them towards one another. This action clamps the bundle 9 already in the binding element 1.

The arms 6 can also be bent somewhat towards one another before the bundle 9 is brought between them.

Then the base 5 of the spine 2 is held against a heating element. The hotmelt adhesive 8 hereby melts, so that an edge of the leaves of the bundle 9 comes into contact with the molten hotmelt adhesive 8.

As a result of cooling, the hotmelt adhesive 8 solidifies again such that the bundle 9 is firmly held in the binding element 1 and a bound bundle 9 is formed, as shown in FIG. 3.

Of course the clamping of the bundle 9 between the arms 6 and the melting of the hotmelt adhesive 8 can also be done in an appropriate machine for this purpose, as is already known for the use of conventional binding elements.

The present invention is by no means limited to the embodiments described as an example and shown in the drawings, but a binding element according to the invention can be realised in all kinds of forms and dimensions without departing from the scope of the invention.

The invention claimed is:

1. A binding element (1) for a bundle of leaves (9), whereby the binding element (1) comprises a spine (2) for enclosing an edge of the bundle (9) and two plastic cover sheets (3,4) fastened to the spine (2), wherein a first of the cover sheets (3) is transparent and the second of the cover sheets (4) is translucent, wherein the spine is a U-shaped spine (2) with a base (5) and two arms (6), and wherein the arms (6) have a length (L) of 9.5 to 11.5 mm.

2. The binding element according to claim 1, wherein the first cover sheet (3) has a gloss surface.

3. The binding element according to claim 1, wherein the second cover sheet (4) has a matt surface.

4. The binding element according to claim 1, wherein the spine (2) is symmetrical with respect to the plane that extends in the centre between the two arms (6) and which is perpendicular to the base (5).

5. The binding element according to claim 1, wherein the inside of the spine (2) is provided with a layer of hotmelt adhesive (8).

6. The binding element according to claim 1, wherein the spine (2) is made of metal, whereby the spine is plastically deformable in order to be able to adjust the distance between the ends of the arms (6) turned away from the base (5).

7. The binding element according to claim 6, wherein the spine (2) is such that it is plastically deformable to enable the adjustment of the said distance by manually pushing the arms (5) towards one another without tools.

8. The binding element according to claim 1, wherein the first cover sheet is a front cover and the second cover sheet is a back cover.

9. The binding element of claim 8, wherein the first and second cover sheets are interchangeable as the front cover and the back cover.

* * * * *